United States Patent [19]

Lonati

[11] Patent Number: 4,538,431

[45] Date of Patent: Sep. 3, 1985

[54] CIRCULAR KNITTING MACHINE INCORPORATING A DEVICE FOR RENEWING A NEEDLE SELECTION AT AT LEAST ONE YARN FEED

[75] Inventor: Francesco Lonati, Brescia, Italy

[73] Assignee: Lonati S.p.A., Brescia, Italy

[21] Appl. No.: 483,530

[22] Filed: Apr. 11, 1983

[30] Foreign Application Priority Data

Apr. 20, 1982 [IT] Italy ..... 20838 A/82

[51] Int. Cl.[3] ..... D04B 9/38; D04B 15/68

[52] U.S. Cl. ..... 66/224; 66/42 R

[58] Field of Search ..... 66/25, 43, 222, 223, 66/224, 226, 227, 42 R

[56] References Cited

U.S. PATENT DOCUMENTS

| | | | |
|---|---|---|---|
| 2,756,575 | 7/1956 | Haddad | 66/43 |
| 3,184,929 | 5/1965 | Reymes-Cole | 66/227 |
| 3,457,734 | 7/1969 | Millar | 66/42 R |
| 3,662,572 | 5/1972 | Lonati | 66/224 |

FOREIGN PATENT DOCUMENTS

| | | | |
|---|---|---|---|
| 1125584 | 3/1962 | Fed. Rep. of Germany | 66/226 |
| 646965 | 10/1962 | Italy | 66/222 |
| 351046 | 6/1931 | United Kingdom | 66/222 |
| 610886 | 6/1978 | U.S.S.R. | 66/222 |

*Primary Examiner*—Wm. Carter Reynolds

*Attorney, Agent, or Firm*—Guido Modiano; Albert Josif

[57] ABSTRACT

A single or double cylinder circular knitting machine is adapted to effect renewal of a needle selection at one or more successive yarn feeds without requiring a respective pattern selection device therefor. The pattern jacks which have been selected, by a preceding pattern selection device, not to bring their respective needles to knit are moved radially inwards by a guiding cam, and are held separated from the other jacks even after the latter have brought their respective needles to knit. The cam may have a first movable part and a second fixed part. At one position of the movable part, the inoperative jacks are moved radially to the inside of the fixed part, and at the second position thereof, radially to the outside thereof, thereby they are restored to the selection position. This allows operation with a programmed selection even where the selection was formerly just reiterated.

8 Claims, 7 Drawing Figures

F
4
7
14
10
3
10
14
10
2
3
8
12
2
3
9
9
15
IV
9
17
12
8
8
18a
1
16
IV
11
19
22
18b
9
2
9
18d
17
3'
20
19'a
8
12
18
9
18c
21
18b
19'
13
13
18'd
16
2

18'

CIRCULAR KNITTING MACHINE INCORPORATING A DEVICE FOR RENEWING A NEEDLE SELECTION AT AT LEAST ONE YARN FEED

BACKGROUND OF THE INVENTION

This invention relates to a circular knitting machine incorporating a device for renewing a needle selection at at least one yarn feed. The machine comprises at least two yarn feeds, at least one associated pattern selection device, a plurality of tiltable pattern jacks associated with the needles and provided with butts for selection by said pattern selection device, a ring cam having raised portions associated with the yarn feeds for guiding the jacks selected to bring the respective needles to knit, and a surface radially inside said ring cam for guiding the jacks selected not to follow said raised portions.

A machine of this type is described in U.S. Pat. No. 3,662,572. In knitting particular knitted products of tubular configuration, such as some hosiery articles, on circular machines of this type, it is often necessary to renew or repeat a given needle selection at a following yarn feed. Such reiteration obviously does not justify the provision of a programmable pattern selection device proper, e.g. a pattern drum and selection slides, which would have the same pattern program as the preceding device and significantly complicate the machine overall construction owing to the additional means required for controlling the device, such as the mechanism for advancing the pattern drum stepwise.

SUMMARY OF THE INVENTION

It is a primary object of this invention to provide a circular knitting machine as indicated, which allows renewal or reiteration of a given needle selection without a pattern selection device proper, but rather through simply implemented means, and further allows any desired pattern selection to be easily restored, whereas renewal of the selection simply took place before.

This and other objects, such as will be apparent from the description which follows, are achieved by a circular knitting machine of the type specified in the preamble, characterized in that adjacent to at least one of said raised portions, on the inboard side thereof, there is provided a guiding cam adapted to move and hold radially inwardly the bottom ends of the jacks selected not to follow said raised portion, said guiding cam extending in a circumferential direction at least as far as the following raised portion.

In a machine so configured, it is possible to save a respective programmable pattern selection device for each selection renewal, since those jacks which have been selected not to follow the first raised portion (inoperative jacks) are held by the guiding cam radially to the inside and hence at such a position as to be prevented from climbing one or more successive raised portions, whereas those jacks which have climbed the first raised portion (operative jacks) are held radially outwards, since they undergo no radial action, and then climb the following raised portion, so that the previously performed selection is retained.

Advantageously, the guiding cam may be made of two parts, a first part being movable and configured to move radially inwards those jacks which have been selected not to climb the associated raised portion, and a second part being fixed and defining with said first part a switching cam operative to hold said jacks radially on the inside when the movable part is in a working position and to return said jacks radially to the outside into a selection position when said movable part is in an inoperative position.

Thus, a desired pattern selection can be restored by arranging a pattern selection device proper and a single movable cam, which, depending on its position, will move the inoperative jacks to the radially innermost side of the switching cam in the event of a selection being repeated or renewed, or allow them to move from the radially outermost side of the switching cam and be returned to the selection position.

BRIEF DESCRIPTION OF THE DRAWINGS

Further features and advantages of the invention will be apparent from the following description of preferred embodiments thereof, given herein by way of example only with reference to the accompanying drawings, where.

DESCRIPTION OF THE PREFERRED EMBODIMENTS

Figures 1, 6:
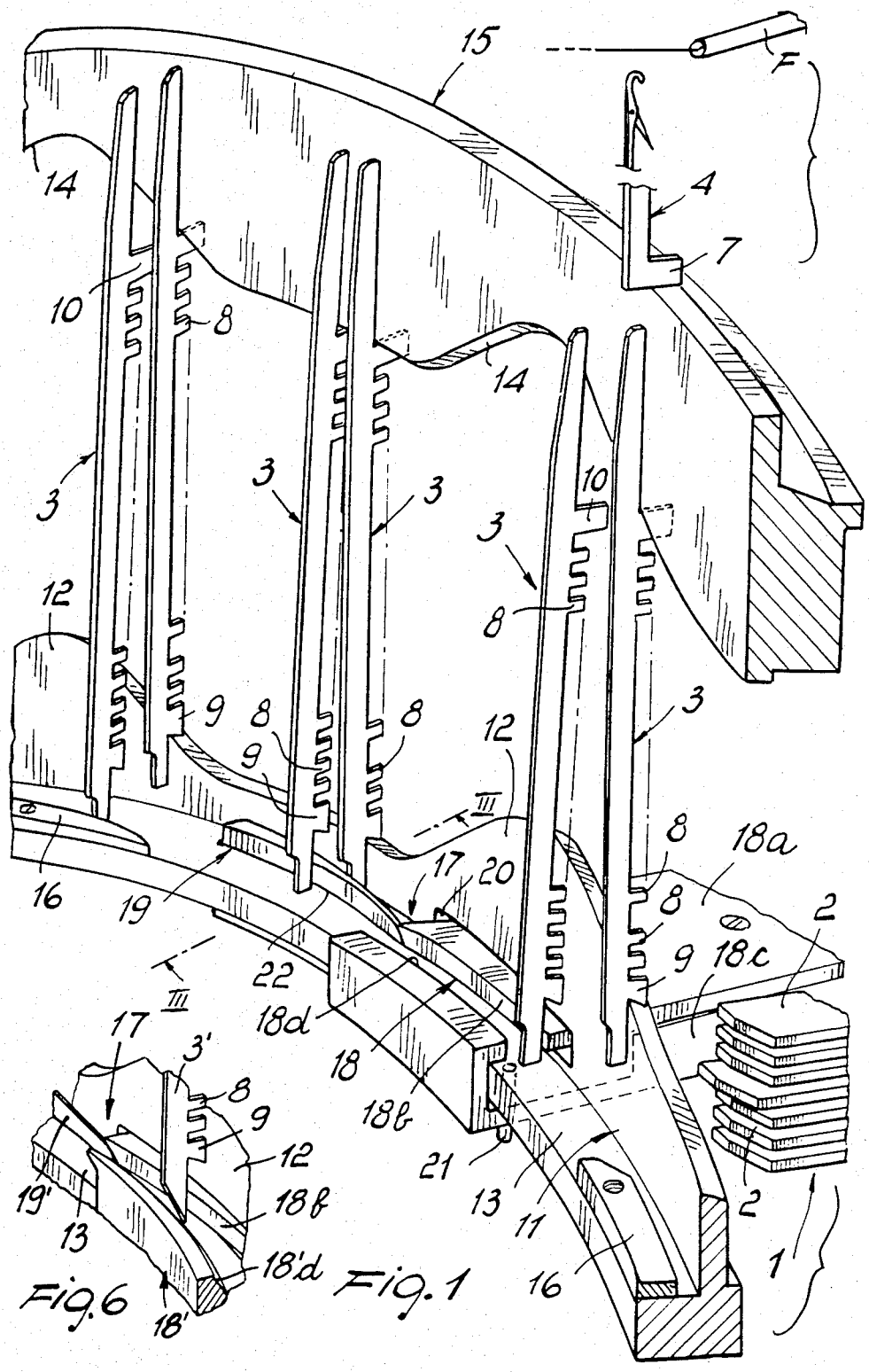
FIG. 1 is a perspective view of a portion of an inventive machine, showing the essential elements for selection renewal.
FIG. 6 is a detail of a modified embodiment of the machine having modified jacks and a modified guiding cam shown in a position corresponding to that of FIG. 1.

Making initial reference to FIG. 1, a circular knitting machine according to this invention, which may be either of the single- or double-cylinder type, comprises at least two yarn feeds F, one only of which is shown in the drawings for convenience of illustration, and at least one pattern selection device 1, in particular of the type including a pattern drum and selection slides, in the drawing only the selection slides 2 being shown.

The machine further comprises a plurality of tiltable pattern jacks 3, associated with respective needles 4 in the grooves 5 of a needle cylinder 6. The needles 4 are provided with conventional drive butts 7, the jacks 3 having pattern butts 8 for selection by the selection slides 2, as well as a lower guiding butt 9 and upper lowering butt 10. The butts 9 are adapted to follow, in a manner known per se, the profile of a ring cam 11 formed with substantially triangular raised portions 12 at the yarn feeds F. As is known, the raised portions 12 are only climbed by those jacks which have been selected to bring their respective needles 4 to knit, i.e. those jacks 3 whose butts 8 are not subjected to the action of a respective slide 2 urged radially toward the cylinder 6 by the program set on the related pattern drum. The jacks 3, whose butts 8 are instead interfering with a respective slide 2 moving toward the cylinder 6, are urged into the respective groove 5 of the cylinder 6 with a tilting movement, to move to the inside of the raised portions 12 with their lower ends in contact with an inner or inboard surface 13 of the ring cam 11, thereby the associated needles 4 are not made to knit. The jacks 3 which have climbed the raised portions 12 are lowered by downward sloping portions 14 of a cam 15 located above the ring cam 11, said portions 14 engaging with the lowering butts 10. Above the cam 15, there are arranged control cams for the needles 4, not shown because of conventional design. On the inner surface 13, ahead of the selection devices 1, there are tilt-out cams 16 for bringing the jacks 3 in a conventional way to a selection position.

In accordance with this invention, at at least one of the raised portions 12, on the inner or inboard side thereof, there is arranged a guiding cam 17, adapted to bring and hold radially to the inside the lower ends of the jacks 3 selected not to follow the raised portion 12. The guiding cam 17 extends circumferentially at least as far as the proximity of the following raised portion 12 and is so configured as not to affect the jacks 3 which follow the profile of the ring cam 11. Thus, all of the inoperative jacks 3, i.e. those selected to stay low and not bring their respective needles 4 to knit, are prevented from climbing the following raised portion 12, and remain accordingly inoperative also at the corresponding yarn feed. On the contrary, those jacks 3 which have been selected to climb the first raised portion 12, follow first the latter and then the contiguous one, being unaffected by any actions which can modify their positions in the radial direction to the cylinder 6. Thus, there will take place a renewal or repetition of the previously carried out selection, and no programmable pattern selection device is any longer required for the yarn feed associated with the following raised portion 12 (in FIG. 1, said device is in fact not shown).

According to a specially advantageous embodiment of the invention, the guiding cam 17 is formed in two parts, namely a first movable part 18 and a second fixed part 19. The movable part 18 is configured to move radially inwardly those jacks 3 which have been selected not to bring their respective needles 4 to knit. To this aim, the movable part 18 comprises a first plate-like element **18*a*, extending substantially radially through a window 20 in the raised portion 12, just above the surface 13, and being provided, on the cylinder 6 side, with a profile 18*b* sloping toward the cylinder 6, i.e. away from the raised portion 12, in the direction of movement of the jacks 3. Rigid with the first element 18*a* is a second element 18*c*, which also extends substantially radially and passes under the ring cam 11. The element 18*c* is provided with a safeguard profile 18*d*, facing the profile 18*b* and effective to limit the radial travel distance of the jacks 3 in the inward direction. Advantageously, the movable part 18 is journaled to the ring cam 11 by means of a vertical axis pivot pin 21, thereby it is movable for rotation between a working position (FIG. 1), whereat it acts with the profile 18*b* on the jacks 3, and an inoperative position (FIG. 2), whereat it does not act on the jacks 3**.

The fixed part 19 of the cam 17, located downstream of the movable part 18, defines with the latter a switching cam adapted to hold the inoperative jacks 3 radially to the inside while the movable part 18 is at its operative or working position, and return the inoperative jacks 3 radially to the outside into a selection position while the movable part 18 is at its inoperative position. The fixed part 19 is, in fact, formed, on its radially inboard side, with an arcuate profile which follows the pattern of the ring cam 11 at a distance away therefrom which is at least equal to the length of the butts 9 of the jacks 3, and on its radially outboard side, with a profile sloping outwardly in the direction of movement of the jacks 3, which progressively urges the jacks 3 into their selection position. The distance of said sloping profile from the ring cam 11 varies, in fact, from a maximum which corresponds to the sum of the radial dimension of the lower end of the jacks 3 plus the length of the butts 8 and 9, to a minimum substantially corresponding to just the radial dimension of the lower end of the jacks 3.

The fixed part 19 has preferably an L-like cross-sectional configuration, with the upright leg of the "L" extending through an opening 22 in the surface 13 of the ring cam 11, and the horizontal leg of the "L" extending under said surface 13, attached thereto. With the movable part 18 in the operative or working position, the profile **18*b* is aligned with the arcuate inboard profile of the fixed part 19, whereas in the inoperative position, the profile 18*b* just protrudes from the ring cam 11, and the profile 18*d* is aligned with the radially outboard profile of the fixed part 19**.

Figures 2, 7:
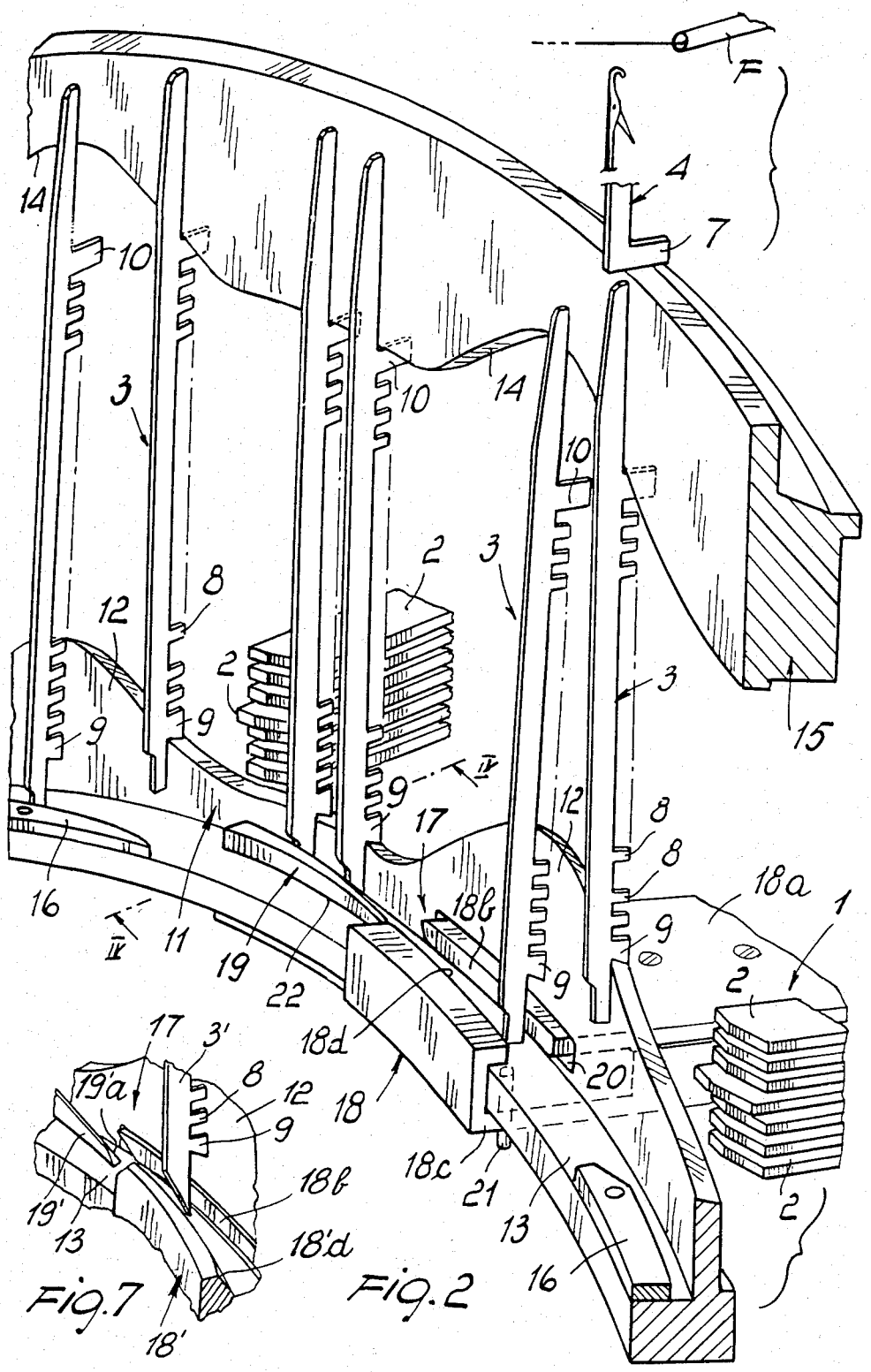
FIG. 2 is a perspective view similar to FIG. 1, but showing the machine set for operation with a pattern selection device even where the latter was not provided before.
FIG. 7 shows the modified embodiment in a position corresponding to that of FIG. 2.

The construction of the guiding cam 17 in two parts advantageously enables the effectuation of any desired pattern selection where it was not provided before. FIG. 2 illustrates that possibility. In fact, with the movable part 18 of the cam 17 in the inoperative position, all of the jacks 3 which have not climbed the raised portion 12 remain on the outside of the fixed part 19 and are returned to the selection position to be again selected by the left-hand selection device as viewed in FIG. 2. By contrast, with the movable part 18 of the cam 17 in the operative position, as shown in FIG. 1, the jacks 3 which have not climbed the raised portion 12 are routed by the radially inboard side of the fixed part 19 and remain inoperative also at the following raised portion 12. The fixed part 19 of the cam 17 extends in this case up to the pattern selection device 1, such as not to hinder selection by the device itself.

It will be understood that the possibility of a pattern selection as described hereinabove is achieved with a single movable cam, and accordingly with a limited construction expenditure.

Figure 3:
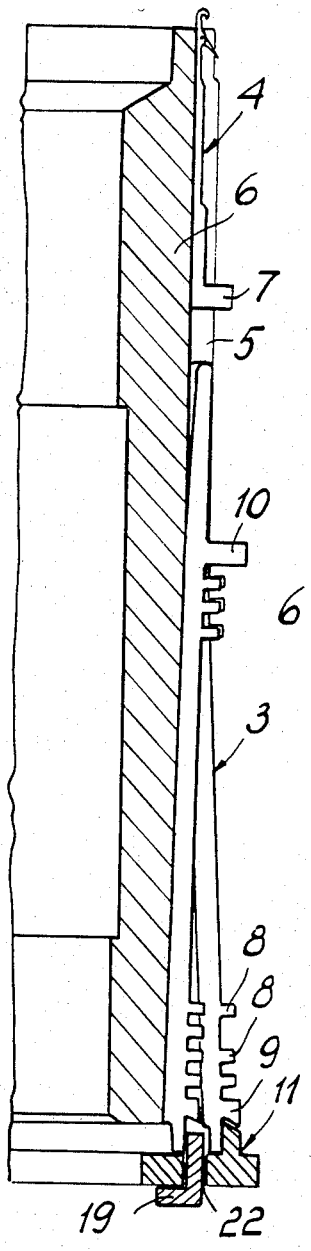
FIGS. 3 and 4 are axial section views of the machine, taken respectively along the lines III—III and IV—IV of FIGS. 1 and 2.
Figure 4:
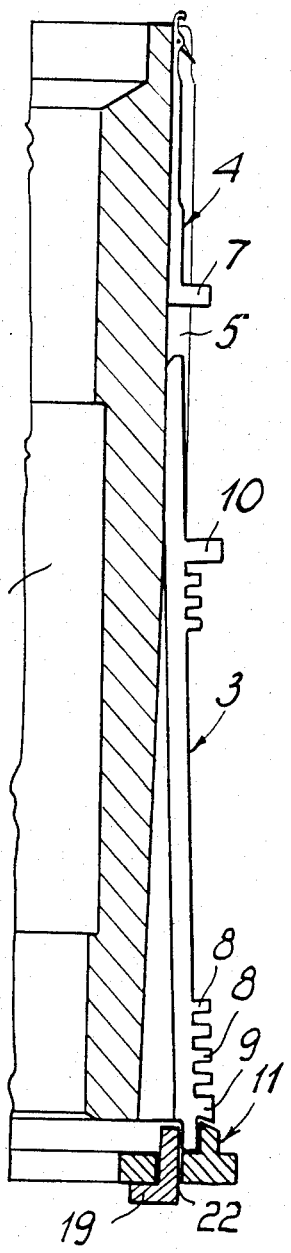
Figure 5:
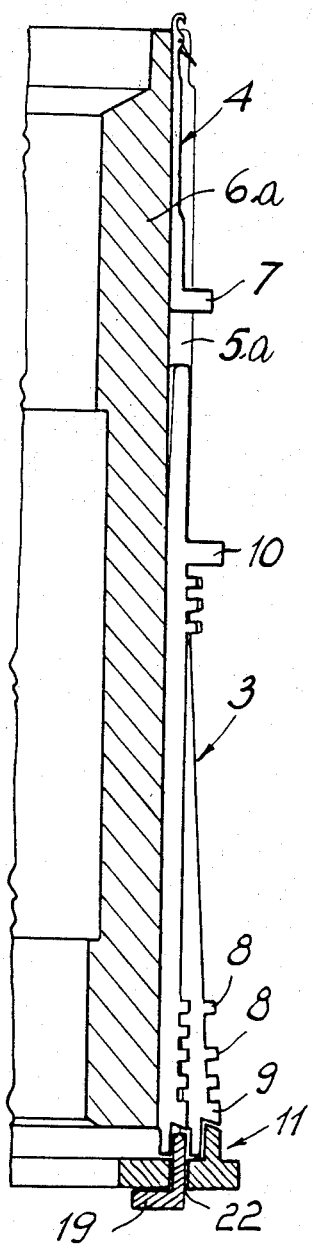
FIG. 5 shows an axial section through a machine similar to the one illustrated in FIGS. 3 and 4, but with modified dimensional proportions for accommodating a conventional needle cylinder.

The provision of the guiding cam 17 may require more room in the radial direction at the lower portion of the cylinder 6. It may become necessary, therefore, to form the grooves 5 with a gradually increasing depth toward the lower portion of the cylinder 6, as shown in the sectional views of FIGS. 3 and 4. However, it will be appreciated that it is also possible to so size the jacks 3 and cam 17 as to require no such deepening, as shown in FIG. 5.

In the modified embodiment shown in FIGS. 6 and 7 the pattern jacks 3' each have a sloping bottom portion that terminates substantially in a pointed end. The sloping portion is defined by a sloped edge of the bottom of the jacks 3' at the radially inward side thereof. Correspondingly, the movable part 18' of the guiding cam 17' has a safeguard profile which has a surface **18'*d* inclined substantially as the sloped edge of the pattern jacks 3' and the fixed part 19' of the guiding cam 17' also has a surface 19'*a* inclined substantially as the sloped edge of the jacks 3' for cooperation therewith when the jacks 3'** are guided radially outward for new selection as shown in FIG. 7.

The reduced area of the bottom portion of the jacks 3' provided by the sloped configuration advantageously reduces or eliminates the danger of impacts against the upstream end of the cam 19' during control of the cam part 18' from the position of FIG. 6 to that of FIG. 7.

The exemplary embodiments of the invention described hereinabove are susceptible to many modifications and variations, without departing from the scope of the instant inventive concept. Thus, for example, as already deducible from the foregoing, the guiding cam 17 could be a single fixed cam, extended to include a number of successive raised portions 12 and so configured as not to affect those jacks 3 which follow the profile of the ring cam 11. The movable part 18 of the guiding cam 17 could also be made, of course, movable in a radial direction. The machine could be provided with slide selection devices 2 at each yarn feed, and one or more thereof be held inoperative, i.e. with all the slides 2 drawn outwards when a preceding selection is to be renewed or repeated.

I claim:

1. A circular knitting machine of the type having at least one needle cylinder and a device for renewing a selection of needles at at least one yarn feed, comprising:

at least two yarn feeds at least one associated pattern selection device a plurality of tiltable pattern jacks associated with said needles and provided with butts for selection by said pattern selection device a ring cam having raised portions associated with said yarn feeds to guide the jacks selected to bring the respective needles to knit a surface radially inside said ring cam for guiding the jacks selected not to follow said raised portions a guiding cam arranged adjacent to at least one of said raised portions on the inward side thereof said guiding cam extending in a circumferential direction at least as far as the next following portion of said raised portions said guiding cam being formed of two members, a first member having a shape capable of an engagement with the lower ends of said jacks, so as to bring radially inwardly the jacks selected not to climb along said one portion of said raised portions of said ring cam, said member being movably mounted on said ring cam for a transverse motion to and from said ring cam, a second fixed member defining with said first member a switching cam adapted to hold said selected jacks radially on the inside when said first member is in an operative position and to return said selected jacks radially to the outside into a selection position when said first member is in an inoperative position.

2. A machine according to claim 1, wherein said movable part comprises a first plate-like element, extending substantially radially through a window in said at least one of said raised portions and having a profile sloping away from said at least one of said raised portions in the direction of movement of said jacks, and a second element rigid with said first element and passing under said ring cam, said second element having a safeguard profile facing said sloping profile of said first element and being effective to limit the radial travel distance to the inside of the jacks selected not to follow said at least one of said raised portions.

3. A machine according to claim 1, wherein said movable part is journaled to said ring cam about a vertical axis.

4. A machine according to claim 1, wherein said fixed part has, on a radially inboard side thereof, an arcuate profile arranged to follow the pattern of said ring cam at a radial distance thereform at least equal to the length of said jack butts, and on the radially outboard side thereof, a profile sloping outwardly in the direction of movement of said jacks, the distance of said sloping profile from said ring cam varying from a maximum substantially corresponding to the sum of the radial dimension of lower ends of said jacks plus the length of said jack butts to a minimum substantially corresponding to just the radial dimension of said jack lower ends.

5. A machine according to claim 1, wherein said fixed part has a substantially L-like cross-sectional configuration, an upright leg of said "L" extending through an opening in an inboard surface of said ring cam and a horizontal leg of said "L" extending under said inboard surface, attached thereto.

6. A machine according to claim 1, further comprising a pattern selection device downstream of said raised portion of said ring cam, said fixed part of said guiding cam extending as far as said pattern selection device.

7. A machine according to claim 2, wherein said jacks each have a sloping bottom portion defined by a sloped edge of said jacks at a radially inward side thereof, and terminating in a substantially pointed end, and said safeguard profile of said movable part has a sloping surface inclined substantially as said sloped edge.

8. A machine according to claim 4, wherein said jacks each have a sloping bottom portion defined by a sloped edge of said jacks at the radially inward side thereof and terminating in a substantially pointed end, and said sloping profile of said fixed part has a sloping surface inclined substantially as said sloped edge.

* * * * *